US010174913B2

(12) United States Patent
Boulanger et al.

(10) Patent No.: US 10,174,913 B2
(45) Date of Patent: Jan. 8, 2019

(54) LIGHTING ARRANGEMENT

(71) Applicant: CP IP Holdings Limited, Central Hong Kong (CN)

(72) Inventors: Dave Boulanger, Hong Kong (CN); Maciej Nowakowski, West Vancouver (CA)

( * ) Notice: Subject to any disclaimer, the term of this patent is extended or adjusted under 35 U.S.C. 154(b) by 0 days.

(21) Appl. No.: 15/712,471

(22) Filed: Sep. 22, 2017

(65) Prior Publication Data

US 2018/0087750 A1 Mar. 29, 2018

Related U.S. Application Data

(60) Provisional application No. 62/399,646, filed on Sep. 26, 2016.

(51) Int. Cl.

| | |
|---|---|
| ***F21V 15/01*** | (2006.01) |
| ***F21S 8/02*** | (2006.01) |
| ***F21K 9/20*** | (2016.01) |
| ***F21V 21/02*** | (2006.01) |
| ***F21V 19/00*** | (2006.01) |
| ***F21V 23/00*** | (2015.01) |
| *F21Y 113/00* | (2016.01) |
| *F21Y 115/10* | (2016.01) |

(52) U.S. Cl.

CPC ..... *F21V 15/01* (2013.01); *F21K 9/20* (2016.08); *F21S 8/026* (2013.01); *F21V 19/003* (2013.01); *F21V 21/02* (2013.01); *F21V 23/007* (2013.01); *F21Y 2113/00* (2013.01); *F21Y 2115/10* (2016.08)

(58) Field of Classification Search

CPC ..... F21V 15/01; F21V 19/003; F21V 21/02; F21V 23/007; F21K 9/20; F21S 8/026; F21Y 2115/10; F21Y 2113/00

USPC ..... 362/147, 148, 364, 365, 366

See application file for complete search history.

(56) References Cited

U.S. PATENT DOCUMENTS

| | | | | |
|---|---|---|---|---|
| 4,174,087 | A | 11/1979 | Gaines | |
| 6,361,193 | B1 * | 3/2002 | Gabrius | F21S 8/02 362/147 |
| 6,616,309 | B2 | 9/2003 | Kelmelis et al. | |
| 7,909,487 | B1 * | 3/2011 | Venetucci | F21S 8/02 362/147 |
| 7,993,039 | B2 | 8/2011 | Nankil et al. | |
| 8,226,278 | B2 | 7/2012 | Ward et al. | |
| 8,474,774 | B2 * | 7/2013 | Svensson | F21S 8/02 248/343 |

(Continued)

FOREIGN PATENT DOCUMENTS

EP 2927565 A1 10/2015

*Primary Examiner* — Laura Tso

(57) ABSTRACT

A lighting arrangement can include a luminaire and a first plurality of spring arms. The luminaire can include a housing assembly and a light emitter portion at least partially enclosing the light emitter portion. The first plurality of spring arms can each be engageable with the luminaire and extend from a respective base end to a respective distal end. The base ends can be positioned closer to the housing assembly than the distal ends. Each of the first plurality of spring arms can extend vertically upward and away from the housing assembly along the axis such that the base ends are vertically lower than the distal ends. Each of the first plurality of spring arms can extend along a torturous path and be cantilevered off of the housing assembly.

20 Claims, 9 Drawing Sheets

(56) References Cited

U.S. PATENT DOCUMENTS

| | | | | |
|---|---|---|---|---|
| 8,845,145 | B1 | 9/2014 | Tam et al. | |
| 2016/0281939 | A1* | 9/2016 | Luk | F21S 8/026 |

* cited by examiner

LIGHTING ARRANGEMENT

CROSS-REFERENCE TO RELATED APPLICATION

This application claims the benefit of U.S. Provisional Patent Application Ser. No. 62/399,646 for a LIGHTING ARRANGEMENT, filed on 26 Sep. 2016, which is hereby incorporated by reference in its entirety.

BACKGROUND

1. Field

The present disclosure relates to lighting fixtures operable to emit light.

2. Description of Related Prior Art

U.S. Pat. No. 4,174,087 discloses a SWIVEL SUSPENSION SET. The overhead swivel suspension set that consists of a mount and a support, i.e. a grab. The set when assembled is used to hang an object, e.g. a floral display or an electric light fixture, from a ceiling or the like. The mount includes a base adapted to be secured to a ceiling, and a horizontal ring held below the base by pendant legs. The base, the legs and the ring are die cast as a single piece. The opening through the ring constitutes a vertical bearing. The upper surface of the ring serves as a horizontal step bearing. The ring is gapped over an arc of considerably less than 180° to provide a radial slot. The support comprises a journal with a grab, e.g. a hook, at its lower end, and an enlarged head at its upper end. The journal, the grab and the head are die cast as a single piece. The journal is rotatable in the opening through the ring so that it can turn about a vertical axis in the mount. The diameter of the journal is greater than the width of the gap. The head rests on the upper surface of the ring. The grab is below the ring. The top of the grab has one transverse dimension narrower than the gap. To connect the support with the mount said narrower dimension of the upper end of the grab is slid through the gap until the journal is centered over the bore, then the journal is dropped into the bore until the head rests on the ring. This locks the support to the ring because the journal is larger than the gap. Such arrangement enables the swivel set to be of a very low height, this including the conjoint heights of the grab, the base, the ring, the journal and the head.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A lighting arrangement can include a luminaire and a first plurality of spring arms. The luminaire can include a housing assembly and a light emitter portion. The housing assembly can at least partially enclose the light emitter portion. The luminaire can extend vertically along and be substantially centered on an axis. The first plurality of spring arms can each be engageable with the luminaire. Each of the first plurality of spring arms can extend from a respective base end to a respective distal end. The base ends of the first plurality of spring arms can be positioned closer to the housing assembly than the distal ends. Each of the first plurality of spring arms can extend vertically upward and away from the housing assembly along the axis such that the base ends are vertically lower than the distal ends. Each of the first plurality of spring arms can extend along a torturous path having a plurality of turns defined between the base end and the distal end. Each of the first plurality of spring arms can be cantilevered off of the housing assembly.

BRIEF DESCRIPTION OF THE DRAWINGS

The detailed description set forth below references the following drawings.

DETAILED DESCRIPTION

Figure 1:
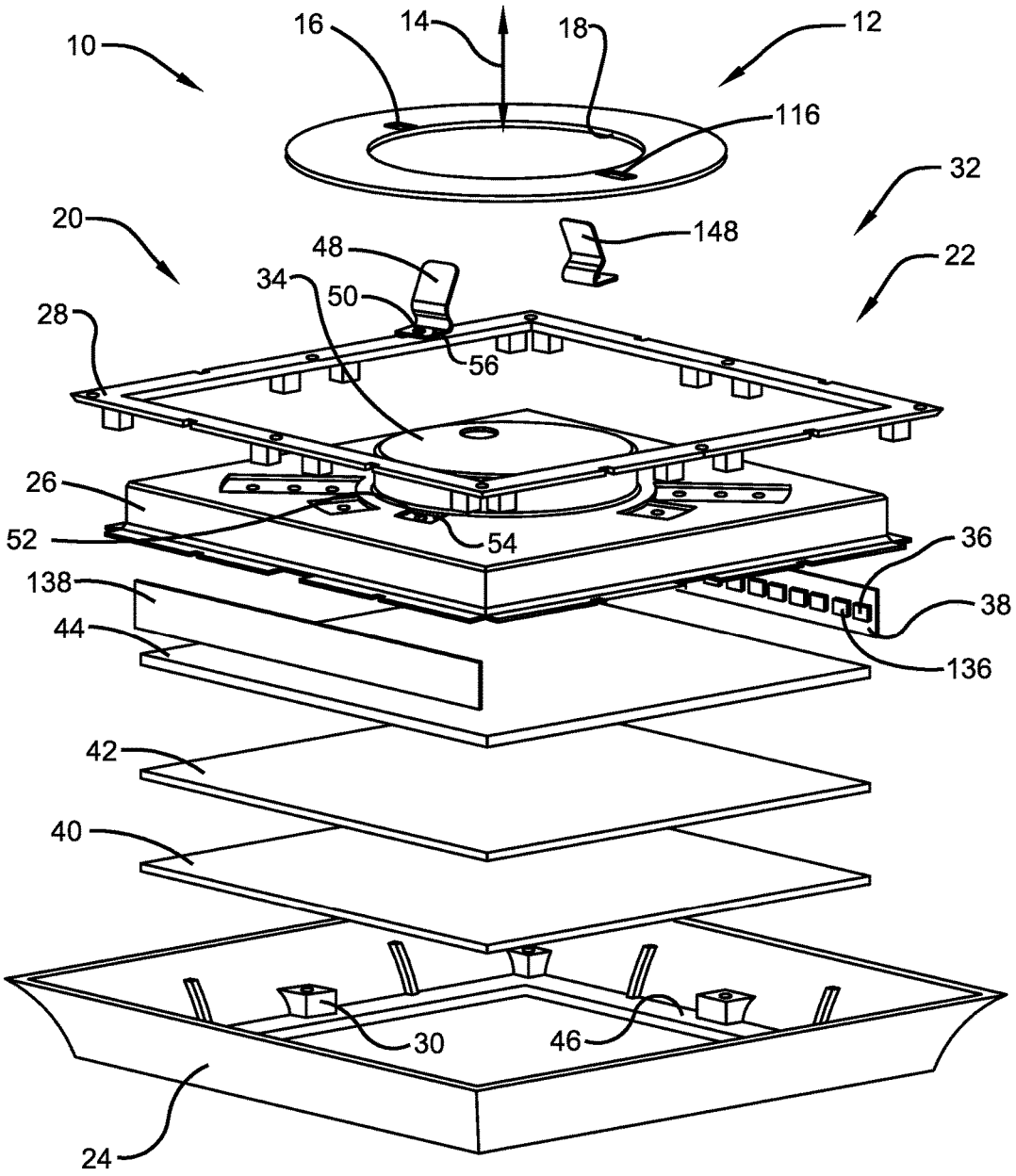
FIG. 1 is an exploded view of a lighting arrangement according to a first exemplary embodiment of the present disclosure.
Figure 2:
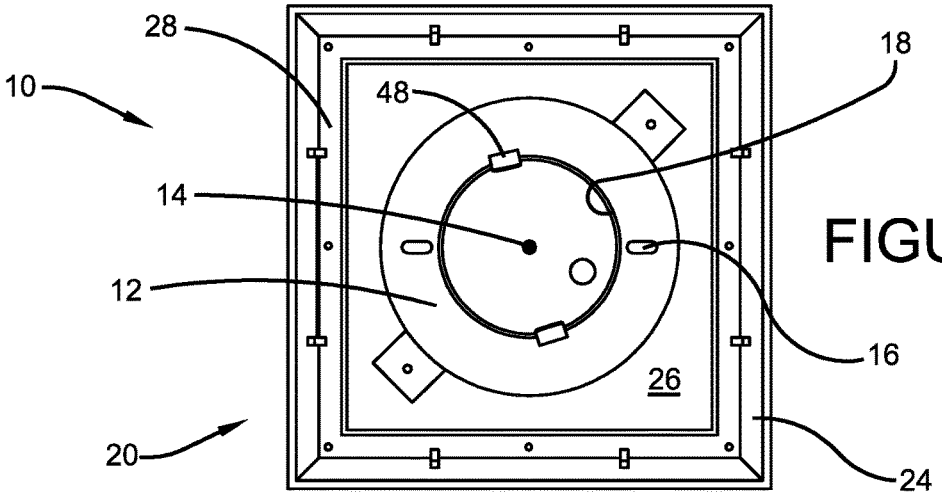
FIG. 2 is a top view, looking down, of the first exemplary embodiment shown in FIG. 1.

A plurality of different embodiments of the present disclosure is shown in the Figures of the application. Similar features are shown in the various embodiments of the present disclosure. Similar features across different embodiments have been numbered with a common reference numeral and have been differentiated by an alphabetic suffix. Similar features in a particular embodiment have been numbered with a common two-digit, base reference numeral and have been differentiated by a different leading numeral. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

FIGS. 1-4 illustrate a first embodiment of the present disclosure. A lighting arrangement 10 can include a mounting bracket or ring 12 extending along a central longitudinal axis 14. The mounting ring 12 can have a plurality of mounting apertures, such as apertures 16, 116. Fasteners can be inserted in apertures 16, 116 to attach the mounting ring 12 to a junction box (not shown). As set forth below, embodiments of the present disclosure can be practiced with a mounting ring that is not connected to a junction box or recessed lighting can with fasteners. The mounting ring 12 can also have a receiving aperture 18. The receiving aperture 18 can be centered on the axis 14 and can be larger than either of the mounting apertures 16, 116.

The lighting arrangement 10 can also include a luminaire 20. The luminaire 20 can extend vertically along and be substantially centered on an axis 14. The luminaire 20 can include a housing assembly 22. The housing assembly 22 can define a cavity. The housing assembly 22 can include pan 26. The lighting arrangement 10 can include a trim 24 and a trim holder 28 that is selectively engageable with the pan 26. The exemplary trim 24 is visible when the lighting arrangement 10 is mounted to a ceiling. The pan 26 can be positioned between the trim 24 and the trim holder 28. The trim and the trim holder 28 can be connected together with one or more fasteners. The fasteners can pass through apertures in the trim holder 28 and be received in bosses in the trim 24, such as boss 30.

The luminaire 20 can also include a light emitter portion 32. The housing assembly 22 can at least partially enclose the light emitter portion 32. The light emitter portion 32 can include driving circuitry 34 and light emitters, such as LEDs 36, 136. It is noted that all of the structures shown as similar to LEDs 36, 136 are LEDs as well. The driving circuitry 34 can be mounted on the pan 26. The LEDs 36 can be mounted on printed circuit boards (PCBs), such as PCBs 38, 138. It is noted that LEDs are mounted on the side of the PCB 138 that is not visible. The PCBs 38, 138 can be positioned in the pan 26. The LEDs can be directed generally toward the axis 14. The lighting arrangement 10 can thus be edge-lit.

The luminaire 20 can also include a lens or glass 40, a diffuser 42, and a light guide 44 with a backing of reflective paper. The pan 26 can have the perimeter wall extending about a central longitudinal axis 14. The perimeter wall can take any desired shape, including square, circular, oval, rectangular, or any other shape. The glass 40, the diffuser 42, and the light guide 44 can be encircled by the pan 26 and can rest on a lip 46 defined by the trim 24. The glass 40 can be at least partially transparent and can be formed from glass or 5VA plastic. The diffuser 42 and the light guide 44 can confront and contact one another. The glass 40, the diffuser 42, and the light guide 44 can enhance the distribution of light generated by the LEDs.

The lighting arrangement 10 can also include spring arms 48, 148 to interconnect the mounting ring 12 and the pan 26. The spring arms 48 can be affixed to the pan 26 with fasteners. For example, a fastener can pass through an aperture 50 defined by the spring arm 48 and an aperture 52 defined by the pan 26. A recess 54 can be defined in the pan 26 and sized and shaped to capture and precisely locate a base end 56 of the spring arm 48. The cooperation between the recess 54 and the base end 56 can allow the end user or the assembly worker to easily align the apertures 50, 52.

Figure 3:
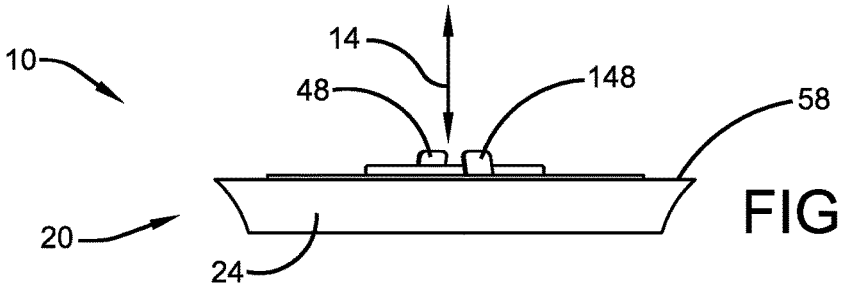
FIG. 3 is a side view of the first exemplary embodiment shown in FIGS. 1 and 2.
Figure 4:
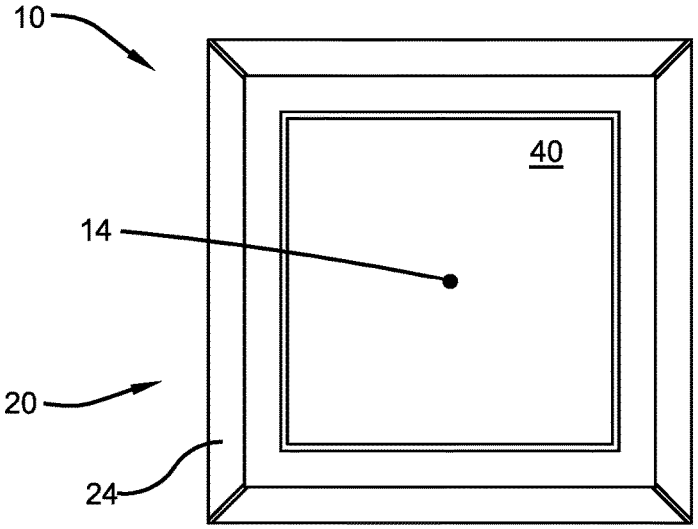
FIG. 4 is a bottom view, looking up, of the first exemplary embodiment shown in FIGS. 1-3.

In operation, the mounting ring 12 can be attached to a junction box. Wiring from the junction box can then be interconnected with wiring from the driving circuitry 34. The luminaire 20 can then be raised so that the spring arms 48, 148 are receiving the receiving aperture 18. The orientation of the luminaire 20 about the axis 14 can then be adjusted as desired. The interaction between the spring arms 48, 148 and the receiving aperture 18 permits rotational movement between the luminaire 20 and the ceiling. It is noted that FIG. 3 shows the assembled lighting arrangement 10, but the portion above a top edge 58 of the trim 24 would not be visible when the lighting arrangement 10 is mounted on a ceiling. The portion above the top edge 58 would be concealed by the ceiling.

Figure 5:
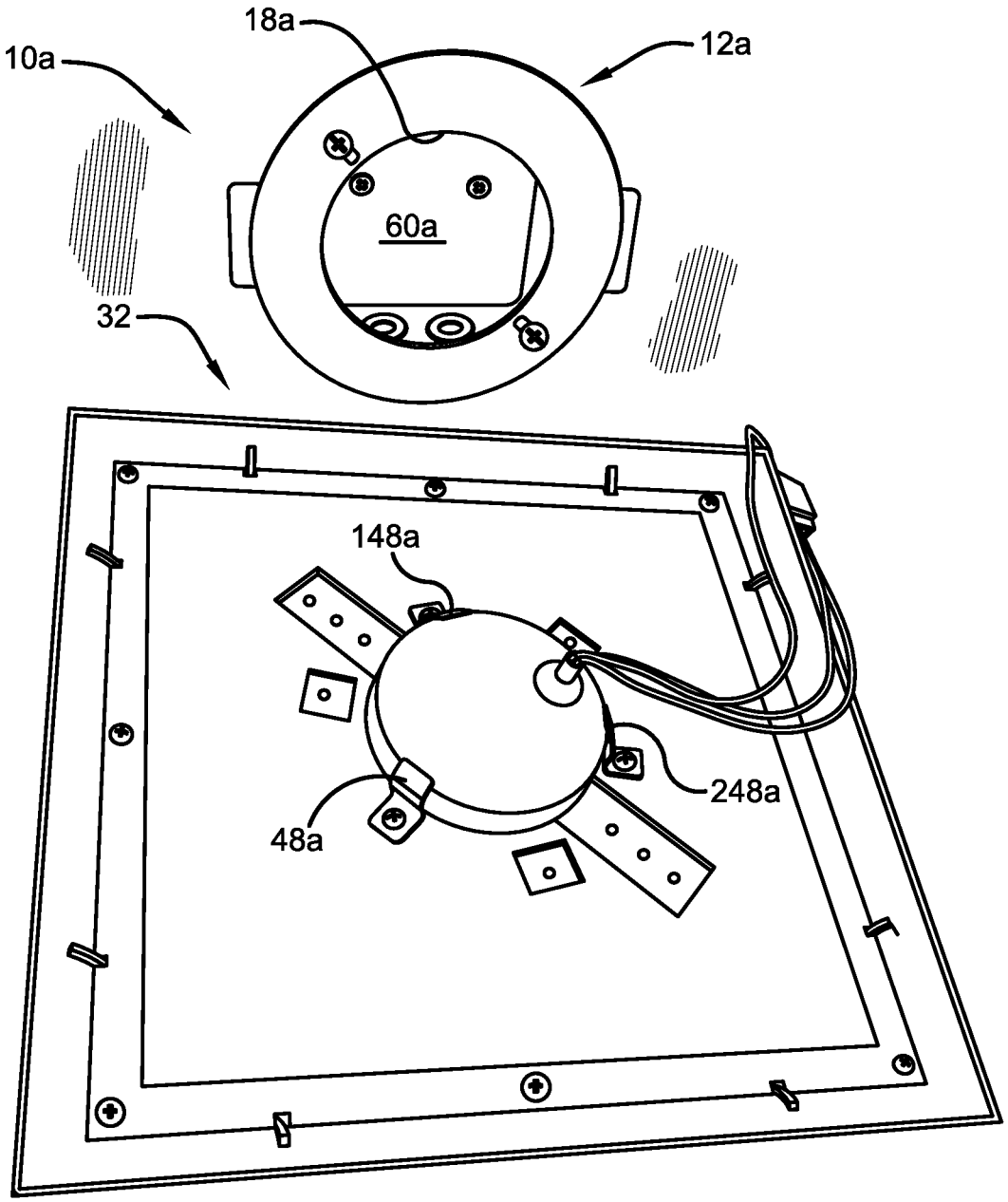
FIG. 5 is a perspective view of a lighting arrangement according to a second exemplary embodiment of the present disclosure being moved into position for assembly to a junction box.

FIG. 5 is a perspective view of a lighting arrangement 10*a* according to a second exemplary embodiment of the present disclosure being moved into position for assembly to a junction box 60*a*. A mounting ring 12*a* is mounted to the junction box 60*a*. The exemplary lighting arrangement 10*a* includes three spring arms 48*a*, 148*a*, 248*a* receivable in a receiving aperture 18*a* of the mounting ring 12*a*. The exemplary spring arms 48*a*, 148*a*, 248*a* are structurally identical to the spring arms 48, 148. Further, the exemplary spring arms 48*a*, 148*a*, 248*a* are structurally identical to one another.

Figure 6:
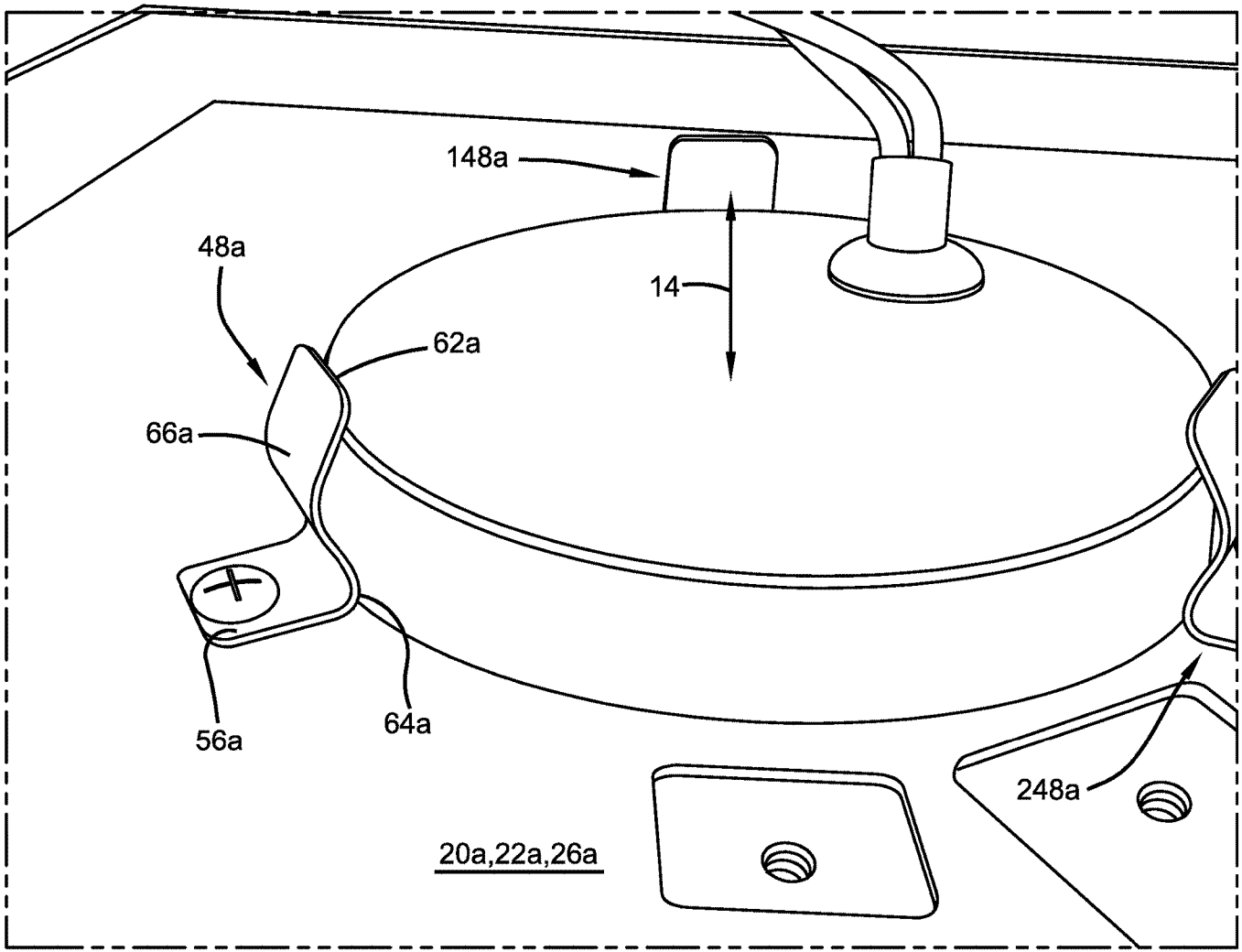
FIG. 6 is a magnified view of a portion of the second exemplary embodiment.

FIG. 6 is a magnified view of a portion of the second exemplary embodiment. As best shown in FIG. 6, the spring arm 48*a* can each be engageable with the luminaire 20*a* and can extend from a base end 56*a* to a distal end 62*a*. The exemplary base end 56*a* is positioned closer to the housing assembly 22*a* than the distal end 62*a*. The exemplary base end 56*a* is mounted to the pan 26*a*. The exemplary spring arm 48*a* extends vertically upward and away from the housing assembly 22*a* along the axis 14*a* such that the base end 56*a* is vertically lower than the distal end 62*a*. The exemplary spring arm 48*a* extends along a torturous path having a plurality of turns defined between the base end 56*a* and the distal end 62*a*. The exemplary spring arm is cantilevered off of the housing assembly 22*a*.

The exemplary spring arm 48*a* extends initially from the base end 56*a* toward the axis 14 in a direction transverse to the axis 14, then extends through a first turn and away from the axis 14 to define a receiving portion, and then extends through a second turn and back towards the axis 14 such that the distal end 62*a* is closer to the axis 14 than the base end 56*a*. Thus, two rounds along the torturous path are defined by the spring arm 48a between the base end 56*a* and the distal end 62*a*. A first round referenced at 64*a* is convex when viewed from an axis 14. A second round referenced at 66*a* is concave when viewed from the axis 14. The distal end 62*a* is tapered toward the axis 14 relative to the round 66*a* to enhance the ease of locating the spring arms in the receiving aperture 18*a*. The spring arm 48*a* can elastically deform as the spring arm 48*a* slides along the receiving aperture 18*a* during insertion. The receiving aperture 18*a* can be received in the round 64*a*when insertion is complete. When the lighting arrangement 10 or l0*a* is in contact with the ceiling, insertion is complete. The lighting arrangement 10 or l0*a* can then be rotated about the axis 14 as desired. The spring arms 48*a*, 148*a*, 248*a* are structured similarly and therefore the description of the spring arm 48*a* is applicable to the spring arms 148*a*, 248*a*.

Figure 7:
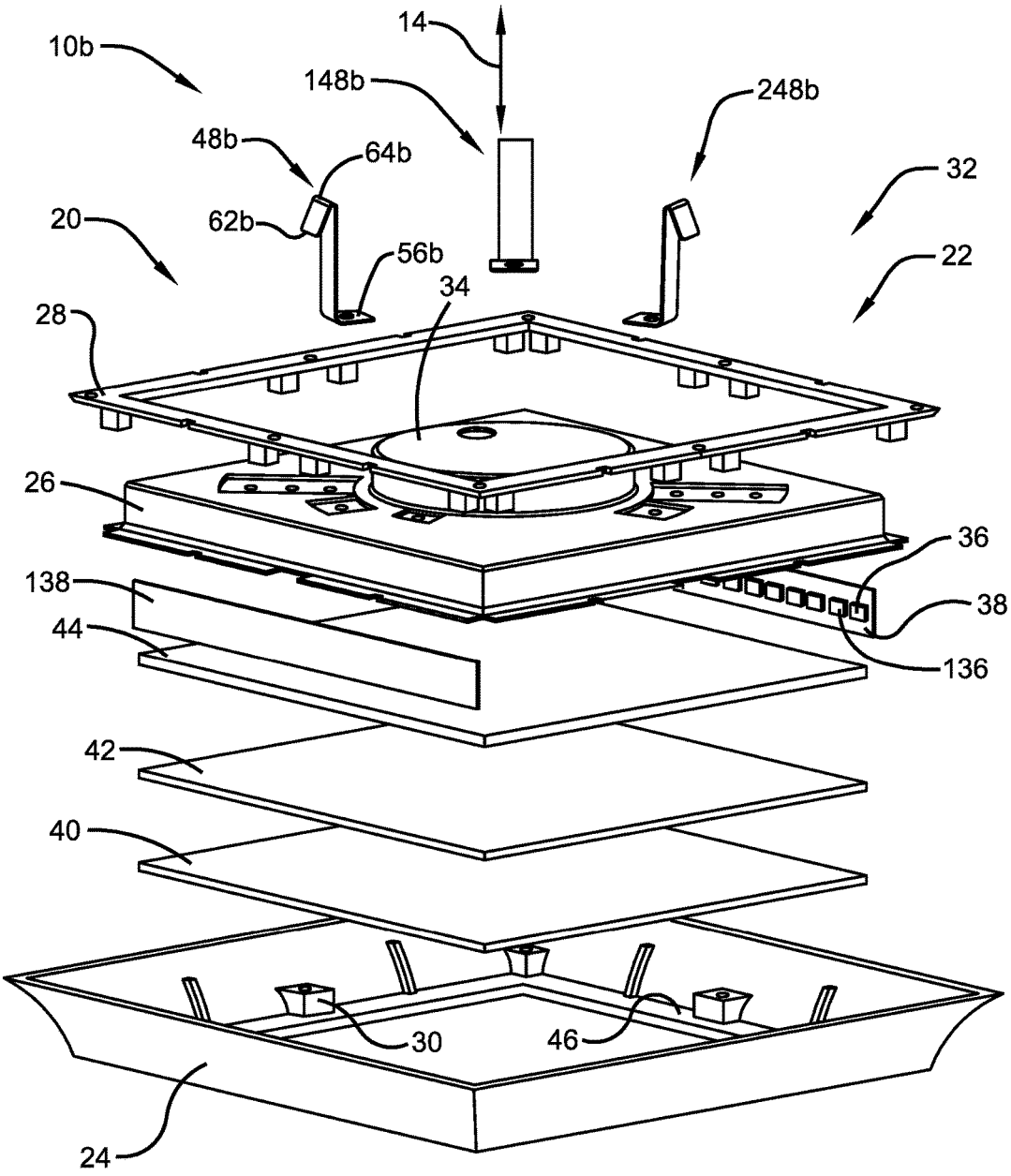
FIG. 7 is an exploded view of a lighting arrangement according to a third exemplary embodiment of the present disclosure.
Figure 8:
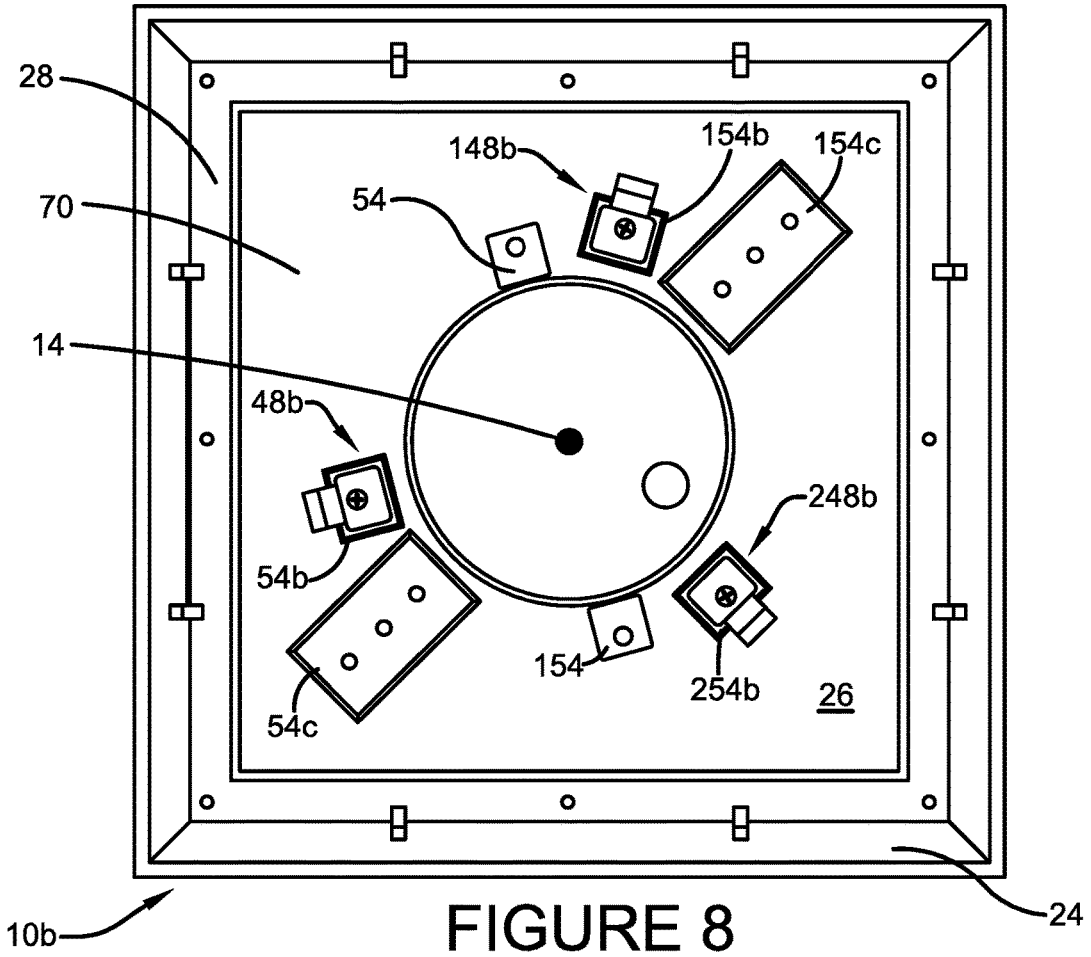
FIG. 8 is a top view, looking down, of the third exemplary embodiment shown in FIG. 7.
Figure 9:
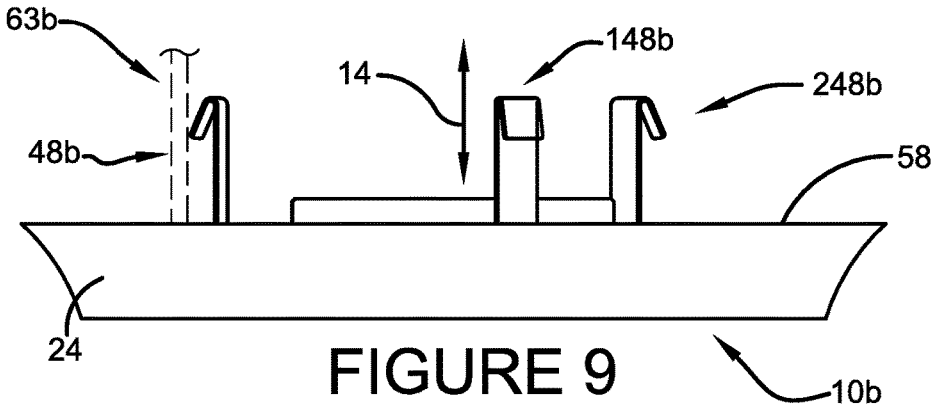
FIG. 9 is a side view of the third exemplary embodiment shown in FIGS. 7 and 8.

FIGS. 7-9 are views of a lighting arrangement 10*b* according to a third exemplary embodiment of the present disclosure. The lighting arrangement 10*b* includes numerous components of the lighting arrangement 10 and the reference numbers have been maintained. The lighting arrangement 10*b* can be mounted to a can (for a recessed light) instead of a junction box. The lighting arrangement 10*b* includes a plurality of spring arms 48*b*, 148*b*, 248*b*. The spring arms 48*b*, 148*b*, 248*b* are structured similarly and therefore the description of the spring arm 48*b* is applicable to the spring arms 148*b*, 248*b*.

The exemplary spring arm 48*b* can each be engageable with the luminaire 20. Each of The exemplary spring arm 48*b* can extend from a respective base end, such base end 56*b*, to a respective distal end, such as distal end 62*b*. The exemplary base ends can be positioned closer to the housing assembly 22 than the distal ends. The exemplary spring arm 48*b* can extend vertically upward and away from the housing assembly 22 along the axis 14 such that the base ends are vertically lower than the distal ends. The exemplary spring arm 48*b* can extend along a torturous path having a plurality of turns defined between the base end 56*b* and the distal end 62*b*. Each of the exemplary spring arms 48*b*, 148*b*, 248*b* can be cantilevered off of the housing assembly 22*b*.

A round 64*b* is defined by the spring arm 48*b* between the base end 56*b* and the distal end 62*b*. The round 64*b* is convex when viewed from the axis 14. The distal end 62*b* is tapered away from the axis 14*b* relative to the round 64*b* so that the distal end 62*b* defines a barb to engage the interior of the can. A portion of a can is shown in phantom in FIG. 9 and referenced at 63*b*. Thus, proceeding from the distal end 62*b*, the exemplary spring arm 48*b* extends in a direction that is toward the axis 14 and also upward. The spring arm 48*b* can elastically deform as the spring arm 48*b* slides along the interior of the can during insertion. When the lighting arrangement 10*b* is in contact with the ceiling, insertion is complete. The lighting arrangement 10*b* can then be rotated about the axis 14 as desired. The distal end 62*b* can frictionally engage the interior of the can to prevent the lighting arrangement 10*b* from dropping out of the can.

Figure 10:
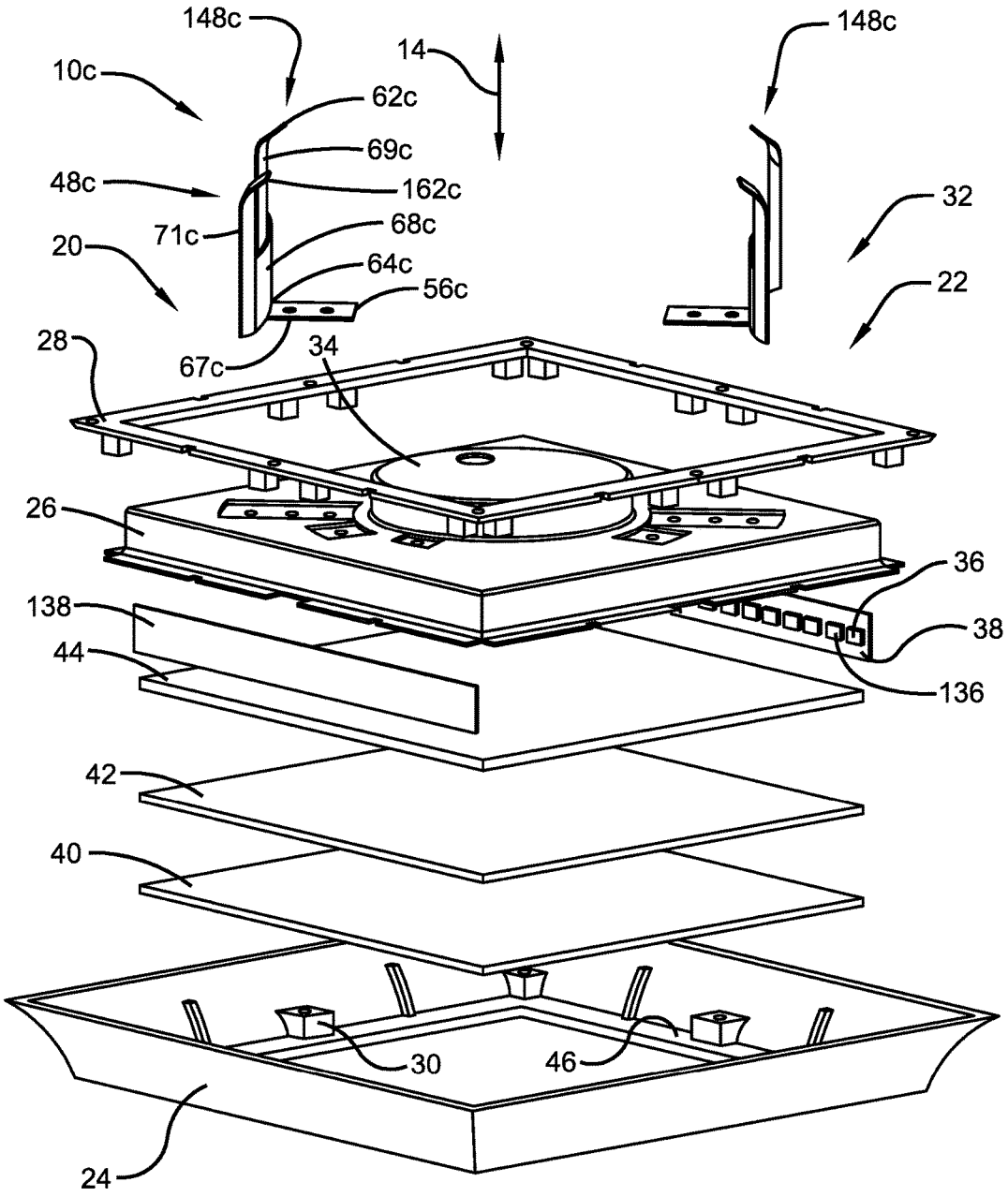
FIG. 10 is an exploded view of a lighting arrangement according to a fourth exemplary embodiment of the present disclosure.
Figure 11:
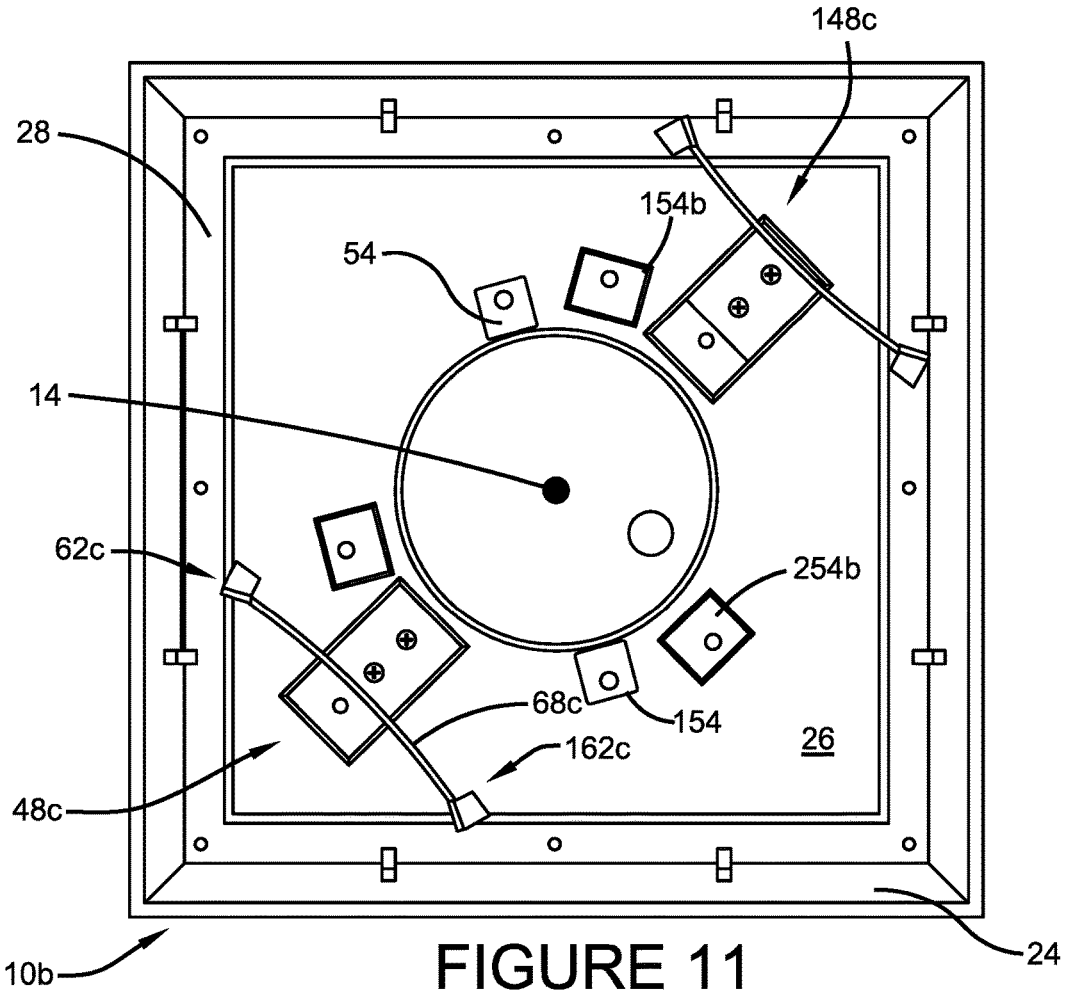
FIG. 11 is a top view, looking down, of the fourth exemplary embodiment shown in FIG. 10.
Figure 12:
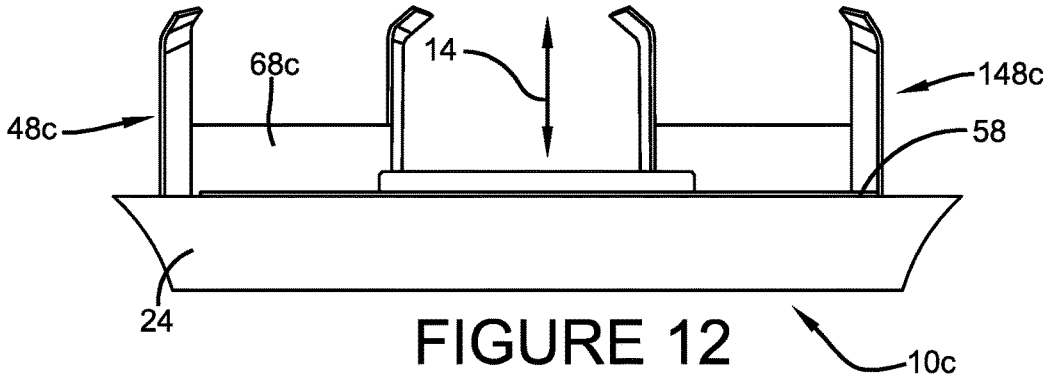
FIG. 12 is a side view of the fourth exemplary embodiment shown in FIGS. 10 and 11.

FIGS. 10-12 are views of a lighting arrangement 10*c* according to a fourth exemplary embodiment of the present disclosure. The lighting arrangement 10*c* includes numerous components of the lighting arrangement 10 and the respective reference numbers have been maintained. The lighting arrangement 10*c* can be mounted to a can (for a recessed light) or a junction box. The lighting arrangement 10*c* includes a plurality of spring arms 48*c* and 148*c*.

The exemplary spring arms 48*c*, 148*c* can each be engageable with the luminaire 20. Each of The exemplary spring arms 48*c*, 148*c* can extend from a respective base end, such base end 56*c*, to a respective distal end, such as distal end 62*c*. The base ends of the exemplary spring arms 48*c*, 148*c* can be positioned closer to the housing assembly 22 than the distal ends. Each of the exemplary spring arms 48*c*, 148*c* can extend vertically upward and away from the housing assembly 22 along the axis 14 such that the base ends are vertically lower than the distal ends. Each of the exemplary spring arms 48*c*, 148*c* can extend along a torturous path having a plurality of turns defined between the respective base ends and the respective distal ends. Each of the exemplary spring arms 48*c*, 148*c* can be cantilevered off of the housing assembly 22.

The exemplary spring arms 48*c* and 148*c* are structurally identical to one another. The exemplary spring arm 48*c* extends from the base end 56*c* and the distal end 62*c* and also extends between the base end 56*c* and a second distal end 162*c* spaced from the distal end 62*c* about the axis 14 (as best shown in FIG. 11). The exemplary spring arm 48*c* extends initially from the base end 56*c* away the axis 14 in a direction transverse to the axis 14, extends through a first turn 64c, and bifurcates to extend along respective mirrored paths to the distal end 62*c* and the second distal end 62*c*.

The exemplary spring arm 48*c* includes a base portion 67*c* defining the base end 56*c*. The exemplary spring arm 48*c* also includes a plate portion 68*c* adjacent to the base portion 67*c*. The exemplary spring arm 48*c* also includes first and second arm members 69*c*, 71*c* projection from the plate portion 68*c*. The first arm member 69*c* defines the distal end 62*c* and the second arm member 71*c* defines the second distal end 162*c*. In the exemplary spring arm 48*c*, the plate portion 68*c* is arcuate in plane transverse to the axis 14 (as best shown in FIG. 11). The plate portion 68*c* can thus act as an additional spring when the lighting arrangement 10 is installed. The distal ends 62*c*, 162*c* are tapered toward from the axis 14*c* relative to the round 64*c* so that the distal ends 62*c*, 162*c* can ease insertion of the spring arm 48*c* into the can.

The spring arms 48*c*, 148*c* and the base 68*c* can elastically deform as the spring arms 48*c*, 148*c* are received in the can. This elastic deformation results in radially outward forces acting through the spring arms 48*c*, 148*c* and into the can. When the lighting arrangement 10*c* is in contact with the ceiling, insertion is complete. The lighting arrangement 10*c* can then be rotated about the axis 14 as desired. The distal ends of the spring arms 48*c*, 148*c* can frictionally engage the interior of the can to prevent the lighting arrangement 10*c* from dropping out of the can.

As demonstrated above, the housing assembly 22 includes an upwardly-facing surface and a plurality of different spring arm mounting patterns arranged on the upwardly-facing surface. Spring arms can be mounted directly to the housing assembly 22 at mounting locations of the mounting patterns. Each of the plurality of different spring arm mounting patterns including at least two mounting locations and each of the at least two mounting locations configured to receive one of the first plurality of spring arms 48. FIG. 8 is a top down view and best shows the upwardly-facing surface, referenced at 70.

A first mounting pattern is defined for the spring arms 48 and 148. The first mounting pattern includes a first mounting location that is defined in the present embodiment by the recess 54. The first mounting pattern also includes a second mounting location that is defined in the present embodiment by a recess 154. Each of the mounting locations (recesses) 54, 154 includes an aperture for receiving a fastener. The two exemplary mounting locations 54, 154 are equally spaced from one another about the axis 14. It is noted that mounting locations in other embodiments of the present disclosure could include structures other than apertures for fasteners to interconnect a spring arm to the housing assembly. For example, slots could be defined on the surface 70 and a base portion of a spring arm could be slipped into such a slot.

A second mounting pattern is defined for the spring arms 48*b*, 148*b*, 248*b*. These springs arms are shown in FIG. 8. The second mounting pattern includes mounting locations recesses) referenced at 54*b*, 154*b*, and 254*b*. The exemplary mounting locations 54*b*, 154*b*,254*b* are recesses like the mounting locations 54 and 154. Each of the mounting locations 54*b*, 154*b*, 254*b*includes an aperture for receiving a fastener. The three exemplary mounting locations 54*b*, 154*b*, 254*b*are equally spaced from one another about the axis 14.

A third mounting pattern is defined for the spring arms 48*c* and 148*c*. The third mounting pattern includes mounting locations referenced at 54*c* and 154*c*. The exemplary mounting locations 54*c* and 154*c* are recesses like the 54 and 154. Each of the mounting locations 54*c*, 154*c* includes three apertures for receiving fasteners. The respective base portions of the spring arms 48*c* and 148*c* include two apertures, so the aperture patterns in the surface 22 allow each of the spring arms 48*c* and 148*c* to be mounted in two different positions. This allows for assembly into differently-sized cans. The two exemplary mounting locations 54*c*, 154*c* are equally spaced from one another about the axis 14.

It is noted that an embodiment of the present disclosure could include spring arms 48, 148; spring arms 48*b*, 148*b*, 248*b*; and spring arms 48*c*, 148*c*, 248*c*. The various spring arms could be supplied with the luminaire 20 as loose parts, to be mounted on the luminaire 20 as desired by the user.

Figure 13:
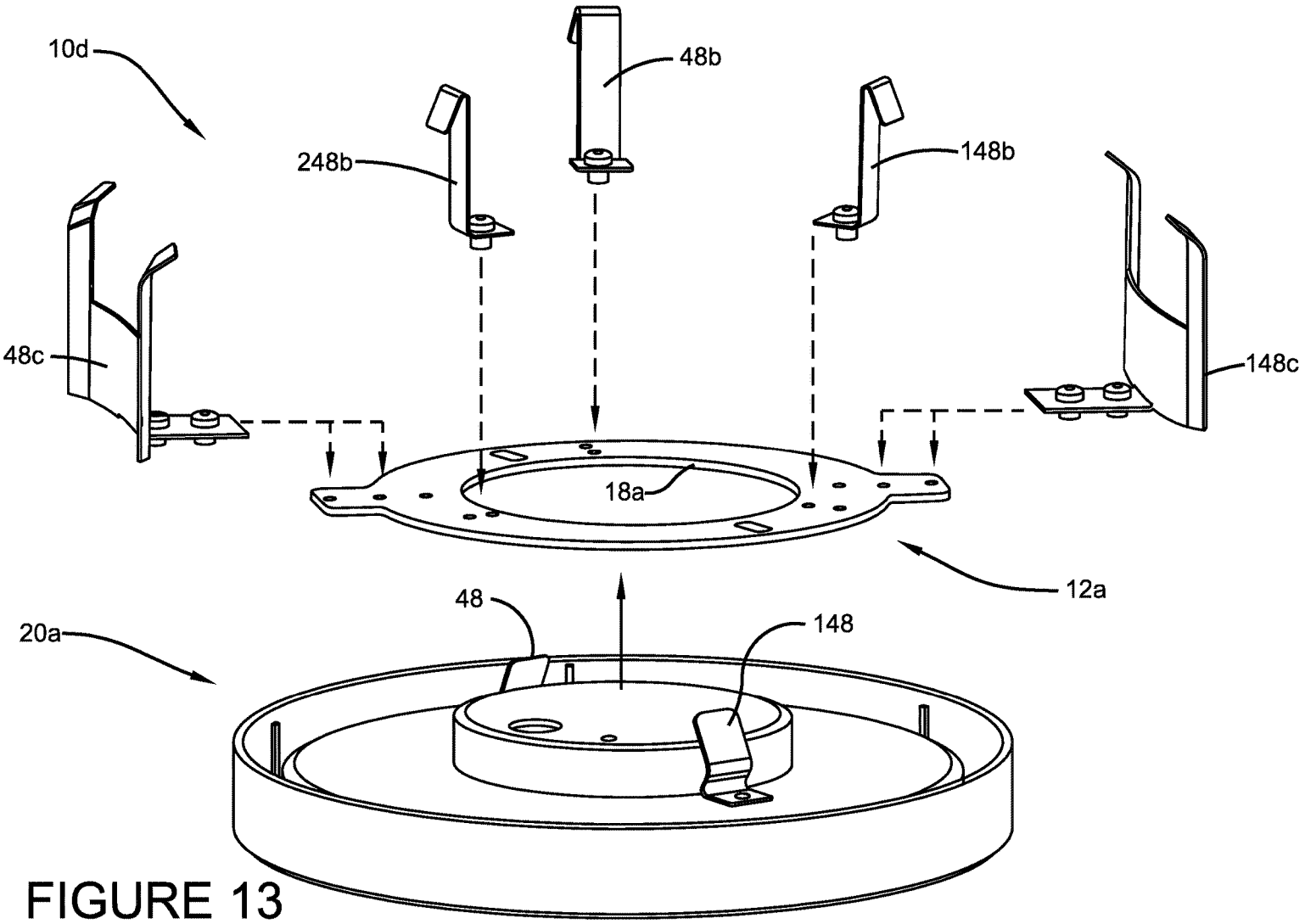
FIG. 13 is an exploded view of a lighting arrangement according to a fifth exemplary embodiment of the present disclosure.

FIG. 13 shows another embodiment of the present disclosure. A luminaire 20*a* is differently shaped from the luminaire 20, but is otherwise the same. A mounting ring 12*a* includes an aperture 18*a*. An exemplary lighting arrangement 10*d* includes a first group of spring arms 48, 148 having a first configuration or shape, a second group of spring arms 48*b*, 148*b*, 248*b* having a second configuration wherein the first configuration and the second configuration are different from one another, and a third group of spring arms 48*c*, 148*c*, 248*c* having a third configuration wherein the first, second and third configurations are different from one another. The first group of spring arms 48, 148 can interconnect the luminaire 20*a* and the mounting ring 12*a*. In the exemplary embodiment, the spring arms 48, 148 are mounted on the luminaire 20*a*, pass through the aperture 18*a* when the mounting ring 12*a* and luminaire 20*a* are brought together during assembly, and releasibly lock the luminaire 20*a* to the mounting ring 12*a*. The engagement between the spring arms 48, 148 and the aperture 18*a* allows the luminaire 20*a* to be rotated relative to the mounting ring 12*a* as desired by the user after the spring arms 48, 148 have been received in the aperture 18*a*.

Prior to interconnecting the luminaire 20*a* and the mounting ring 12*a*, the user can select one of the second and third groups of spring arms, connect the selected group to the mounting ring 12*a*, and mount the ring 12*a* to a recessed can. The second and third groups of spring arms can be more robust than the first group of spring arms so that removal of the luminaire 20*a* from the mounting ring 12*a* requires less force than removal of the mounting ring 12*a* from the can.

The mounting ring 12*a* defines a plurality of different patterns of mounting locations, one pattern for each if the second and third groups of spring arms. The user can select the second or third group based on the size of the can. As shown in FIG. 13, the mounting ring 12*a* can define apertures allowing each of the spring arms 48*c*, 148*c* to be positioned at two different locations that radially spaced from one another (an outer position and an inner position).

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or subcombinations that are disclosed herein as other present disclosures in other patent documents is hereby unconditionally reserved.

What is claimed is:

1. A lighting arrangement comprising:

a luminaire having a housing assembly and a light emitter portion, said housing assembly at least partially enclosing said light emitter portion, said luminaire extending vertically along and substantially centered on an axis;

a first plurality of spring arms each engageable with said luminaire, each of said first plurality of spring arms extending from a respective base end to a respective distal end, said base ends of said first plurality of spring arms positioned closer to said housing assembly than said distal ends, wherein each of said first plurality of spring arms extends vertically upward and away from said housing assembly along said axis such that said base ends are vertically lower than said distal ends, wherein each of said first plurality of spring arms extend along a torturous path having a plurality of turns defined between said base end and said distal end, and wherein each of said first plurality of spring arms are cantilevered off of said housing assembly; and wherein at least one of said first plurality of spring arms defines a barb at said distal end whereby said at least one of said first plurality of spring arms extends from said distal end in a direction that is toward said axis and also upward, said barb engagable with an interior of a recessed can.

2. The lighting arrangement of claim 1 wherein said housing assembly further comprises an upwardly-facing surface and a plurality of different spring arm mounting patterns arranged on said upwardly-facing surface, each of said plurality of different spring arm mounting patterns including at least two mounting locations and each of said at least two mounting locations configured to receive one of said first plurality of spring arms.

3. A lighting arrangement comprising:

a luminaire having a housing assembly and a light emitter portion, said housing assembly at least partially enclosing said light emitter portion, said luminaire extending vertically along and substantially centered on an axis;

a first plurality of spring arms each engageable with said luminaire, each of said first plurality of spring arms extending from a respective base end to a respective distal end, said base ends of said first plurality of spring arms positioned closer to said housing assembly than said distal ends, wherein each of said first plurality of spring arms extends vertically upward and away from said housing assembly along said axis such that said base ends are vertically lower than said distal ends, wherein each of said first plurality of spring arms extend along a torturous path having a plurality of turns defined between said base end and said distal end, and wherein each of said first plurality of spring arms are cantilevered off of said housing assembly;

wherein at least one of said first plurality of spring arms extends between said base end and said distal end and also extends between said base end and a second distal end spaced from said distal end about said axis; and wherein said at least one of said first plurality of spring arms extends initially from said base end away from said axis in a direction transverse to said axis, extends through a first turn, and bifurcates to extend along respective mirrored paths to said distal end and said second distal end.

4. The lighting arrangement of claim 3 wherein said housing assembly further comprises an upwardly-facing surface and a plurality of different spring arm mounting patterns arranged on said upwardly-facing surface, each of said plurality of different spring arm mounting patterns including at least two mounting locations and each of said at least two mounting locations configured to receive one of said first plurality of spring arms.

5. A lighting arrangement comprising:

a luminaire having a housing assembly and a light emitter portion, said housing assembly at least partially enclosing said light emitter portion, said luminaire extending vertically along and substantially centered on an axis;

a first plurality of spring arms each engageable with said luminaire, each of said first plurality of spring arms extending from a respective base end to a respective distal end, said base ends of said first plurality of spring arms positioned closer to said housing assembly than said distal ends, wherein each of said first plurality of spring arms extends vertically upward and away from said housing assembly along said axis such that said base ends are vertically lower than said distal ends, wherein each of said first plurality of spring arms extend along a torturous path having a plurality of turns defined between said base end and said distal end, and wherein each of said first plurality of spring arms are cantilevered off of said housing assembly;

wherein at least one of said first plurality of spring arms extends between said base end and said distal end and also extends between said base end and a second distal end spaced from said distal end about said axis; and wherein said at least one of said first plurality of spring arms further comprises:

a base portion defining said base end;

a plate portion adjacent to said base portion; and first and second arm members projection from said plate portion, said first arm member defining said distal end and said second arm member defining said second distal end.

6. The lighting arrangement of claim 5 wherein said plate portion is arcuate in plane transverse to said axis.

7. The lighting arrangement of claim 5 wherein said housing assembly further comprises an upwardly-facing surface and a plurality of different spring arm mounting patterns arranged on said upwardly-facing surface, each of said plurality of different spring arm mounting patterns including at least two mounting locations and each of said at least two mounting locations configured to receive one of said first plurality of spring arms.

8. A lighting arrangement comprising:

a luminaire having a housing assembly and a light emitter portion, said housing assembly at least partially enclosing said light emitter portion, said luminaire extending vertically along and substantially centered on an axis;

a first plurality of spring arms each engageable with said luminaire, each of said first plurality of spring arms extending from a respective base end to a respective distal end, said base ends of said first plurality of spring arms positioned closer to said housing assembly than said distal ends, wherein each of said first plurality of spring arms extends vertically upward and away from said housing assembly along said axis such that said base ends are vertically lower than said distal ends, wherein each of said first plurality of spring arms extend along a torturous path having a plurality of turns defined between said base end and said distal end, and wherein each of said first plurality of spring arms are cantilevered off of said housing assembly;

wherein said housing assembly further comprises an upwardly-facing surface and a plurality of different spring arm mounting patterns arranged on said upwardly-facing surface, each of said plurality of different spring arm mounting patterns including at least two mounting locations and each of said at least two mounting locations configured to receive one of said first plurality of spring arms; and wherein at least one of said plurality of different spring arm mounting patterns is defined at least in part by one or more apertures.

9. A lighting arrangement comprising:

a luminaire having a housing assembly and a light emitter portion, said housing assembly at least partially enclosing said light emitter portion, said luminaire extending vertically along and substantially centered on an axis;

a first plurality of spring arms each engageable with said luminaire, each of said first plurality of spring arms extending from a respective base end to a respective distal end, said base ends of said first plurality of spring arms positioned closer to said housing assembly than said distal ends, wherein each of said first plurality of spring arms extends vertically upward and away from said housing assembly along said axis such that said base ends are vertically lower than said distal ends, wherein each of said first plurality of spring arms extend along a torturous path having a plurality of turns defined between said base end and said distal end, and wherein each of said first plurality of spring arms are cantilevered off of said housing assembly;

wherein said housing assembly further comprises an upwardly-facing surface and a plurality of different spring arm mounting patterns arranged on said upwardly-facing surface, each of said plurality of different spring arm mounting patterns including at least two mounting locations and each of said at least two mounting locations configured to receive one of said first plurality of spring arms: and wherein at least one of said plurality of different spring arm mounting patterns includes more than two mounting locations and said mounting locations are equally spaced from one another about said axis.

10. A lighting arrangement comprising:

a luminaire having a housing assembly and a light emitter portion, said housing assembly at least partially enclosing said light emitter portion, said luminaire extending vertically along and substantially centered on an axis;

a first plurality of spring arms each engageable with said luminaire, each of said first plurality of spring arms extending from a respective base end to a respective distal end, said base ends of said first plurality of spring arms positioned closer to said housing assembly than said distal ends, wherein each of said first plurality of spring arms extends vertically upward and away from said housing assembly along said axis such that said base ends are vertically lower than said distal ends, wherein each of said first plurality of spring arms extend along a torturous path having a plurality of turns defined between said base end and said distal end, and wherein each of said first plurality of spring arms are cantilevered off of said housing assembly;

wherein said housing assembly further comprises an upwardly-facing surface and a plurality of different spring arm mounting patterns arranged on said upwardly-facing surface, each of said plurality of different spring arm mounting patterns including at least two mounting locations and each of said at least two mounting locations configured to receive one of said first plurality of spring arms; and wherein at least one of said plurality of different spring arm mounting patterns includes a first spring arm mounting pattern having two mounting locations equally spaced from one another about said axis and a second spring arm mounting pattern having more than two mounting locations equally spaced from one another about said axis.

11. A lighting arrangement comprising:

a luminaire having a housing assembly and a light emitter portion, said housing assembly at least partially enclosing said light emitter portion, said luminaire extending vertically along and substantially centered on an axis;

a first plurality of spring arms each engageable with said luminaire, each of said first plurality of spring arms extending from a respective base end to a respective distal end, said base ends of said first plurality of spring arms positioned closer to said housing assembly than said distal ends, wherein each of said first plurality of spring arms extends vertically upward and away from said housing assembly along said axis such that said base ends are vertically lower than said distal ends, wherein each of said first plurality of spring arms extend along a torturous path having a plurality of turns defined between said base end and said distal end, and wherein each of said first plurality of spring arms are cantilevered off of said housing assembly; and wherein said first plurality of spring arms further comprises:

a first group of spring arms having a first configuration; and a second group of spring arms having a second configuration, said first configuration and said second configuration different from one another.

12. A lighting arrangement comprising:

a luminaire having a housing assembly and a light emitter portion, said housing assembly at least partially enclosing said light emitter portion, said luminaire extending vertically along and substantially centered on an axis;

a first plurality of spring arms each engageable with said luminaire, each of said first plurality of spring arms extending from a respective base end to a respective distal end, said base ends of said first plurality of spring arms positioned closer to said housing assembly than said distal ends, wherein each of said first plurality of spring arms extends vertically upward and away from said housing assembly along said axis such that said base ends are vertically lower than said distal ends, wherein each of said first plurality of spring arms extend along a torturous path having a plurality of turns defined between said base end and said distal end, and wherein each of said first plurality of spring arms are cantilevered off of said housing assembly; and a mounting ring having an aperture wherein said first plurality of spring arms extend through said aperture and interconnect said luminaire with said mounting ring.

13. The lighting arrangement of claim 12 wherein said housing assembly further comprises an upwardly-facing surface and a plurality of different spring arm mounting patterns arranged on said upwardly-facing surface, each of said plurality of different spring arm mounting patterns including at least two mounting locations and each of said at least two mounting locations configured to receive one of said first plurality of spring arms.

14. The lighting arrangement of claim 12 wherein said first plurality of spring arms are elastically deformed during movement through said aperture.

15. The lighting arrangement of claim 12 further comprising:

a second plurality of spring arms each engageable with said mounting ring, each of said second plurality of spring arms extending from a respective base end to a respective distal end, said base ends of said second plurality of spring arms positioned closer to said mounting ring than said distal ends, wherein each of said second plurality of spring arms extends vertically upward and away from said mounting ring such that said base ends are vertically lower than said distal ends, wherein each of said second plurality of spring arms extend along a torturous path having a plurality of turns defined between said base end and said distal end, wherein each of said second plurality of springs arm are cantilevered off of said mounting ring.

16. The lighting arrangement of claim 15 wherein said first plurality of spring arms and said second plurality of spring arms are differently shaped from one another.

17. The lighting arrangement of claim 16 wherein each of said first plurality of spring arms extends initially from said base end toward said axis in a direction transverse to said axis, extends through a first turn and away from said axis to define a receiving portion that receives an edge of said aperture of said mounting ring, and extends through a second turn and back towards said axis such that said distal end is closer to said axis than said base end.

18. The lighting arrangement of claim 17 wherein each of said second plurality of spring arms defines a barb at said distal end whereby said each of said second plurality of spring arms extends from said distal end in a direction that is toward said axis and also upward.

19. The lighting arrangement of claim 17 each of said second plurality of spring arms extends between said base end and said distal end and also extends between said base end and a second distal end spaced from said distal end about said axis.

20. The lighting arrangement of claim 19 wherein each one of said second plurality of spring arms further comprises:

a base portion defining said base end;

a plate portion adjacent to said base portion; and first and second arm members projection from said plate portion, said first arm member defining said distal end and said second arm member defining said second distal end.

* * * * *